US005397063A

United States Patent [19]

Weinstein

[11] Patent Number: 5,397,063

[45] Date of Patent: Mar. 14, 1995

[54] ROTARY ATOMIZER COATER

[75] Inventor: Richard Weinstein, Toledo, Ohio

[73] Assignee: Asahi Sunac Corporation, Aichi, Japan

[21] Appl. No.: 861,954

[22] Filed: Apr. 1, 1992

[51] Int. Cl.[6] ..... B05B 5/04

[52] U.S. Cl. ..... 239/703; 239/700; 239/706

[58] Field of Search ..... 239/223, 690, 699, 700, 239/703, 704, 706

[56] References Cited

U.S. PATENT DOCUMENTS

| | | | |
|---|---|---|---|
| D. 283,832 | 5/1986 | Weinstein et al. | D23/18 |
| 4,380,320 | 4/1983 | Hollstein et al. | 239/704 |
| 4,402,030 | 8/1983 | Moser et al. | 361/93 |
| 4,406,468 | 9/1983 | Gimple et al. | 277/115 |
| 4,520,949 | 6/1985 | Seitz et al. | 222/108 |
| 4,555,058 | 11/1985 | Weinstein et al. | 239/223 |
| 4,657,184 | 4/1987 | Weinstein | 239/296 |
| 4,721,255 | 1/1988 | Lind | 239/690 |
| 4,811,906 | 3/1989 | Prus | 239/700 |
| 4,896,834 | 1/1990 | Coeling et al. | 239/691 |
| 4,899,936 | 2/1990 | Weinstein | 239/224 |
| 4,919,333 | 4/1990 | Weinstein | 239/223 |
| 4,928,883 | 5/1990 | Weinstein | 239/223 |
| 4,936,507 | 6/1990 | Weinstein | 239/71 |
| 4,936,509 | 6/1990 | Weinstein | 239/112 |
| 4,936,510 | 6/1990 | Weinstein | 239/223 |
| 4,943,005 | 7/1990 | Weinstein | 239/223 |
| 4,943,178 | 7/1990 | Weinstein | 239/224 X |
| 4,997,130 | 3/1991 | Weinstein | 239/222 |
| 5,039,019 | 8/1991 | Weinstein et al. | 239/691 |
| 5,071,074 | 12/1991 | Lind | 239/690 |

*Primary Examiner*—Andres Kashnikow
*Assistant Examiner*—Lesley D. Morris
*Attorney, Agent, or Firm*—Emch, Schaffer, Schaub & Porcello Co.

[57] ABSTRACT

The rotary atomizer coater is particularly adaptable to a high voltage rotary atomizer coater which can be robot mounted. A rotatable bell cup, which is mounted on a turbine driven shaft is positioned within a housing. A fluid tube within the housing includes a fluid discharge tip which extends through an inlet opening in the bell cup for supplying charged coating fluid directly to the inner surface of the bell cup interior which is open to atmosphere. An electrical resistor is mounted between the fluid discharge tip and a power supply within the housing. When a grounded object approaches the bell cup, the current between the bell cup and the grounded object will increase and voltage drop across the resistor results, thereby reducing the voltage at the bell cup and diminishing the potential for a high energy spark.

13 Claims, 4 Drawing Sheets

ROTARY ATOMIZER COATER

BACKGROUND OF THE INVENTION

The invention relates to a coating apparatus and, more particularly, to an improved rotary atomizer coater for depositing paint or other fluid coatings on a workpiece. The rotary atomizer coater of the present invention may be used with a robot mounting or in connection with other types of work place applications or apparatus.

Rotary atomizer coaters having a disk or bell cup are known in the art. Often the bell cups are driven by air motors, such as air driven turbines. Examples of prior art rotary atomizer coaters are described in U.S. Pat. Nos. 4,405,086 and 4,555,058. In rotary atomizer coaters a fluid coating which is to be atomized is supplied and charged electrostatically with a high voltage. Often these voltages are from approximately 20 to 100 KV. The bell cups are rotated at high speeds normally between 10,000 and 40,000 rpm. The charged fluid is fed to an inner chamber of the rotating bell cup where it is centrifuged forwardly through chamber openings to the large diameter edge of the cone and is broken up into atomized particles as it escapes the bell cup edge. The axial centerline of the spinning bell cup points toward an electrically grounded workpiece which is to be coated. Normally, the workpiece is located approximately 10 inches (25.4 cm) in front of the bell cup. Because the atomized particles are centrifuged in a direction perpendicular to the axial centerline of the bell, it is known in prior art devices to redirect these particles so that they move toward the workpiece. In some situations, the electrostatic charge held by the atomized coating particles is sufficient to attract the particles to the grounded workpiece. It is also known in prior art rotary coaters to supply a cylindrically shaped curtain of shaping air which also directs the particles toward the workpiece. The shaping air also controls the diameter of the spray particle pattern. Prior art atomizer coaters having shaping air apparatus are described in U.S. Pat. Nos. 4,776,520 and 4,899,936. In many prior art rotary atomizer coaters, when a coating fluid is delivered to the bell cup in excess of the amount which can be dispensed by the bell cup, the coating fluid often will backup into the shaft and housing openings at the rear of the bell cup. This is undesirable, particularly when such coating fluid can damage the rotary mechanism of the shaft and bearing assembly.

In any electrically charged rotary atomizer system, it is important to make every effort to minimize the chance of an arc of sufficient energy which can ignite the coating fluid being fed to or being atomized by the bell cup.

In prior art atomizer coaters, where a cylinder of shaping air is utilized to direct the particles as they leave the bell cup edge, the high velocity shaping air often creates a negative pressure zone and causes ambient air to be drawn towards and along side the shaping air. Electrically charged particles in the vicinity are often drawn backwardly into this negative pressure zone, where they tend to become deposited on the surface of the rotary atomizer coater housing.

High voltage ladder or cascade power supplies are known in the art. It has been found that because the electronic components in these potted or encapsulated power supplies create heat which cannot be easily removed, many of the prior art power supplies are short lived.

Another problem found in the prior art are found in the bearings which rotatably mount the rotary atomizer coater shaft. Air bearings are known in prior art rotary atomizer coaters but are generally complex and expensive. These prior art air bearings often use composite materials including bronze, white metal and other materials which are mixed, formed to a close tolerance and machined. A tetrafluoroethene homopolymer, such as a TEFLON material is often mixed with the bearing material to reduce friction.

Because bell cups are rotated at high speeds, it is important to accurately mount the bell cups on the shaft to minimize out-of-balance radial load amplification at high speeds.

SUMMARY OF THE INVENTION

The invention relates to an improved rotary atomizer coater which includes a longitudinally extending housing having a front end and a rear end. A bell cup having an interior open to atmosphere is rotatably mounted adjacent the front end of the housing. The bell cup defines an inlet opening at its rear end. A coating supply means is mounted within the housing. The coating supply means includes a fluid discharge tip which extends through the bell cup inlet opening for supplying charged coating fluid directly to the bell cup interior.

A power supply is mounted within the housing. A charging electrode is positioned adjacent the fluid discharge tip and an electrical resistor means is mounted between the charging electrode and the power supply means. Preferably, spring means are provided to urge the resistor, the electrode and the power supply into desired electrical communication.

In one embodiment, a turbine driven shaft is rotatably mounted in the housing. The front end of the shaft includes an inner outwardly tapered surface and an opposed outer threaded surface. The rotary bell cup has a conical wall defining an outer tapered surface which mates with the outwardly tapered surface of the shaft. The bell cup preferably includes a rearwardly directed circular wall attached to the conical wall. The circular wall has an inner surface which define threads which mate with the outer threaded surface of the shaft. This design ensures correct concentric mounting of the bell cup relative to the shaft and also shortens the overall length of the bell cup and its mounting. Extra length and weight of any bell cup magnifies any radial imbalances due to the extended moment created by an overhanging bell cup mass.

In one embodiment of the invention, the rotatable shaft is mounted by an aluminum air bearing assembly. The aluminum air bearing assembly has an inner surface which is anodized. A layer of a tetrafluoroethene homopolymer, such as a TEFLON material, is impregnated into the open cells of the anodized aluminum inner surface adjacent the shaft.

In a preferred embodiment, the shaft is turbine driven and a turbine exhaust air passageway is defined within the housing. A plurality of shaping air passageways are located in the front of the housing concentric with the bell cup and a shaping air conduit supplies shaping air to the shaping air passageways. A plurality of exhaust air openings are positioned outwardly of the shaping air passageways. The exhaust air openings are in communication with the exhaust air passageway. Exhaust air is directed forwardly of the housing to form a protective, generally cylindrical, air layer to retard charged coating spray particles from moving toward the shaping air and the housing.

In the preferred embodiment, the housing includes a plastic shroud means and a rear plastic cover. A potted power supply is mounted within the housing adjacent the rear end. The power supply includes heat producing components. A metallic member is mounted within the potted power supply adjacent the rear plastic cover. The metallic member extends rearwardly from within the potted power supply and through the plastic cover and includes an electrical connector in communication with the power supply. A plurality of fins extend outwardly from the metallic member. The heat producing components of the power supply are connected to or positioned adjacent the metallic member, whereby the fins transfer heat from within the potted power supply which contains the heat producing components to atmosphere.

DESCRIPTION OF THE PREFERRED EMBODIMENTS

Figure 1:
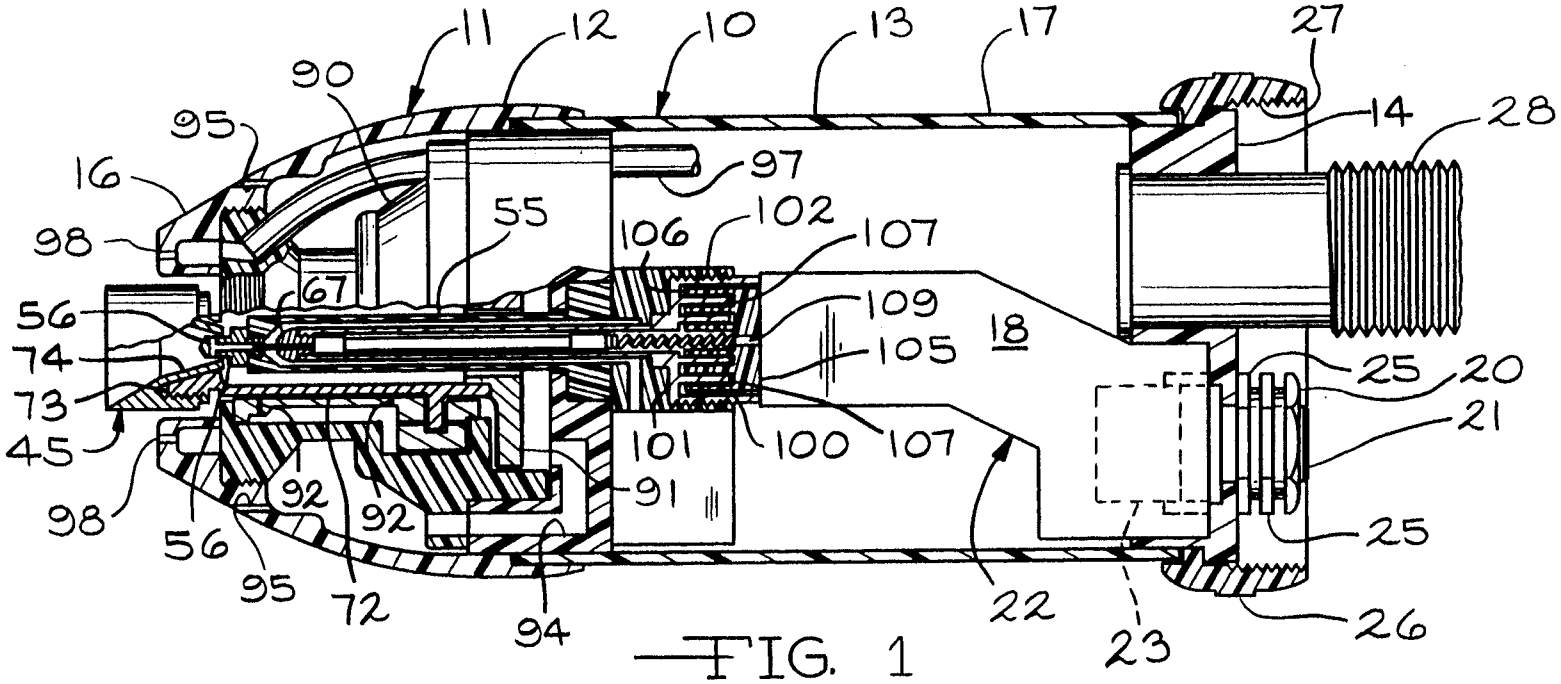
FIG. 1 is a cross sectional view, with parts removed for clarity, of a rotary atomizer coater, according to the present invention.

Referring to the drawings, a rotary atomizer coater, according to the present invention, is generally indicated by the reference number 10. The rotary atomizer coater 10 includes a longitudinally extending housing 11. In the present embodiment, the housing 11 includes a forward shroud 12, a connected rear shroud 13 and a rear cover 14. The housing 11 including the shrouds 12 and 13 and rear cover 14 are all constructed of an electrically nonconductive plastic material. The housing 11 includes a front end 16 and a rear end 17. A high voltage power supply 18 is positioned in the rear end 17 of the housing 11. The high voltage power supply 18 is a potted power supply capable of transforming a low voltage supply of between 5 and 20 volts into a high voltage supply in the range of 20 to 100 KV. A low voltage supply line is indicated by the reference number 19 in FIG. 2. A generally cylindrical metallic member 20 is mounted within the potted power supply 18 adjacent the plastic rear cover 14 and extends rearwardly from the cover 14. The metallic member 20 includes an electrical connector 21 which receives the low voltage supply line 19 and connects the line 19 to the input of the power supply 18. The front end of the metallic member 20 is potted within a plastic cover 22 which encloses the power supply components. Referring to FIG. 1, a plurality of heat generating electronic components such as transistors and resistors are indicated by the reference number 23. The heat generating electronic components 23 are located adjacent the metallic member 20 and the plastic rear cover 14. The metallic member 20 includes a plurality of fins such as the circular fins 25 which extend outwardly, The metallic member 20 including the fins 25 transfer heat from the electronic components 23 to the atmosphere. This tends to extend the life of the electronic components 23.

Figure 2:
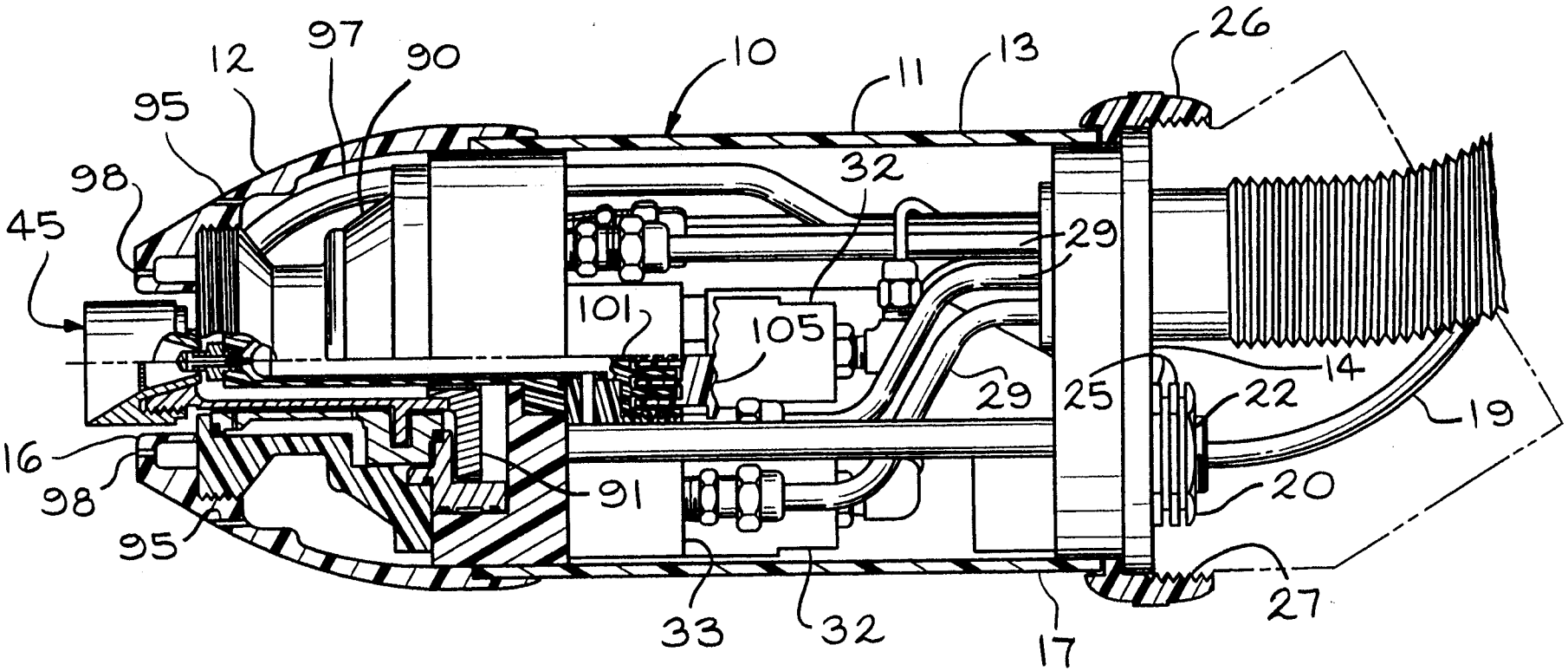
FIG. 2 is a view similar to FIG. 1, with a portion of the power supply removed to show other portions of the interior of the rotary atomizer coater.

In the present embodiment, a mounting ring 26 including internal threads 27 is mounted adjacent the rear cover 14. The ring 26 is used to connect the overall rotary atomizer coater 10 to a supporting structure, such as a robot structure. As best shown in FIG. 2, a corrugated sleeve 28 extends through the rear cover 14. A plurality of conduits 29 extend through the sleeve 28 into the housing 11. Selected ones of the conduits 29 are, for example, connected to valves 32.

Figure 7:
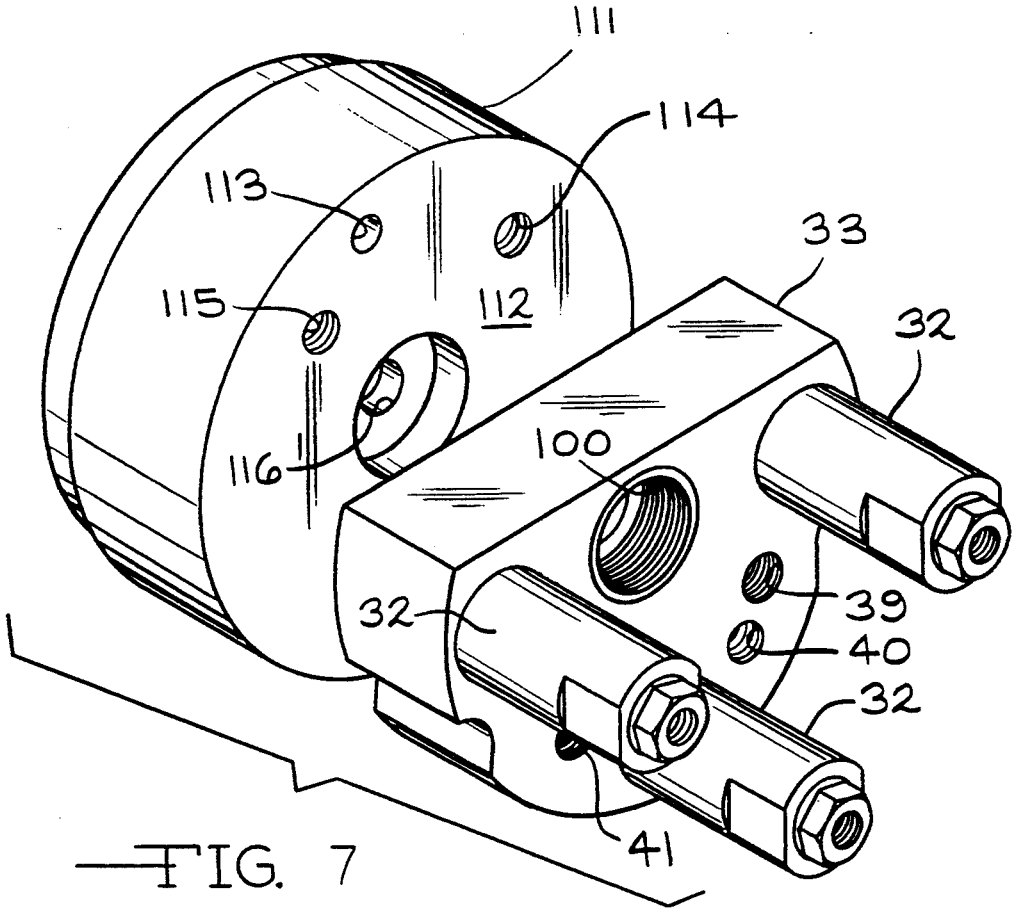
FIG. 7 is an exploded, perspective view of the fluid manifold and the turbine cover.

Referring to FIGS. 2 and 7, the valves 32 extend rearwardly from a fluid manifold 33 which is mounted within the housing 11. The valves 32 include a solvent valve, a trigger or fluid coating valve, and a dump valve.

A threaded opening is provided in the fluid manifold 33 to receive a portion of a resistor tube 44, as will be discussed below (see FIG. 5). Referring to FIGS. 1 and 2, a metallic bell cup 45 is rotatably mounted adjacent the front end 16 of the housing 11. The bell cup 45 has an interior 46, which is open directly to the atmosphere. The bell cup 45 defines a rear inlet opening 47 at its rear end and defines an annular discharge edge 48 at its front end. The interior 46 of the bell cup 45 defines connecting conical inner surfaces 49 and 50. The inner surface 49 extends from the inlet opening 47 to the inner surface 50. The inner surface 50 then extends to the annular discharge edge 48. In the present embodiment, a radially extending shoulder 52 is mounted on the conical inner surface 49. The shoulder 52 defines a plurality of axial openings 53 which are circumferentially spaced. In the present embodiment, the axial openings 53 comprise axially extending grooves, but can also be holes. In operation, the radial shoulder 52 offers a partial restriction to the centrifuging coating fluid. The grooves or openings 53 distribute the coating fluid evenly as it moves along the inner surface 49, through the grooves 53 of the shoulder 52 and along the connecting inner surface 50 to the annular discharge edge 48. If excessive fluid is dispensed into the bell cup 45, it will be forced to flow inwardly over the lip of the shoulder 52 as well as through the grooves or openings 53 in the shoulder 52. Therefore, the charged coating fluid does not tend to back up.

Figure 5:
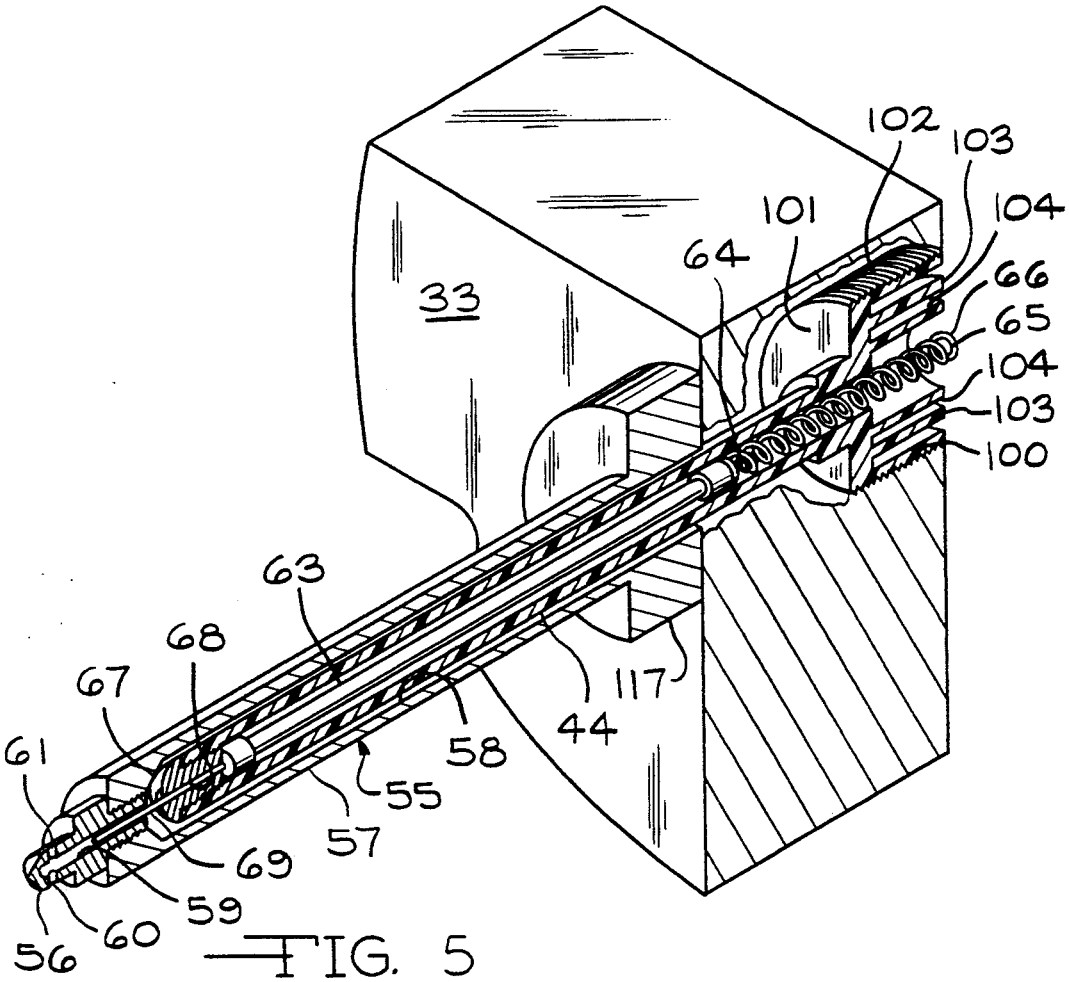
FIG. 5 is a perspective view, partially in cross section, of the resistor tube assembly and a portion of the fluid manifold.
Figure 6:
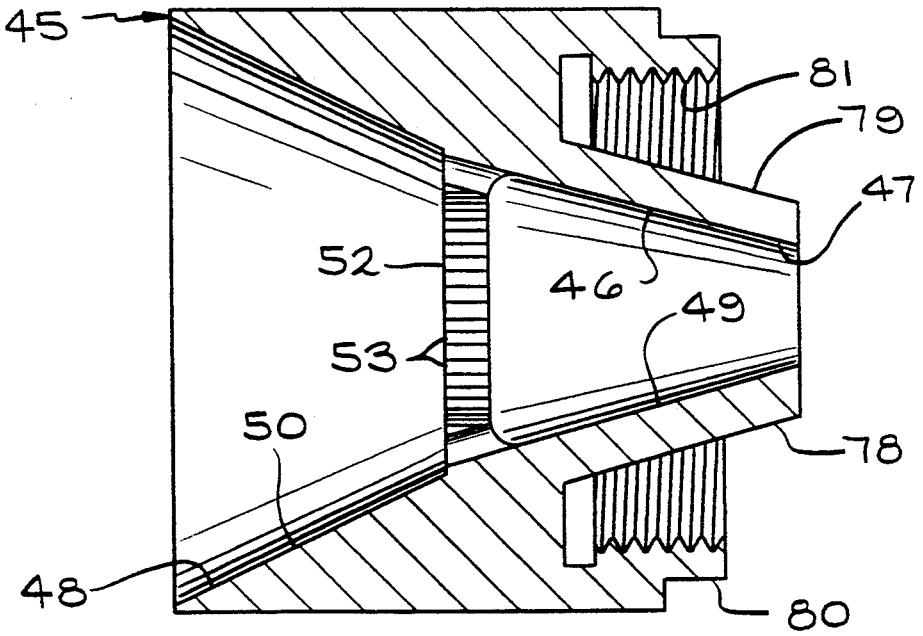
FIG. 6 is an enlarged, cross sectional view of a bell cup, according to the present invention.

Referring to FIGS. 1 and 5, a coating supply means 55 is mounted within the housing 11. The coating supply means 55 includes a fluid discharge tip 56 which extends through the inlet opening 47 of the bell cup 45 for supplying charged coating fluid directly to the bell cup interior 46. This is an important feature of the rotary atomizer coater, according to the present invention, in that the charged coating fluid is introduced directly into the bell cup 45 and does not impinge on an internal bell cup chamber or cavity where such charged fluid can backup.

The coating supply means 55 includes a longitudinally extending fluid tube 57 which defines a central passageway 58 for supplying fluid coating from the fluid manifold 33. The fluid discharge tip 56 is mounted on the front end of the fluid tube 57 and defines an axial passageway 59. In the present embodiment, the axial passageway 59 in the tip 56 is in communication with opposed discharge passageways 60 and 61 which extend generally perpendicular to the longitudinal axis of the passageway 59. The fluid coating material from the central passageway 58 is in liquid communication with the axial passageway 59 and with the discharge passageways 60 and 61. The discharge passageways 60 and 61 direct charged coating material to the conical inner surface 49 of the bell cup 45, where it is centrifuged forwardly to the annular discharge edge 48.

Figure 3:
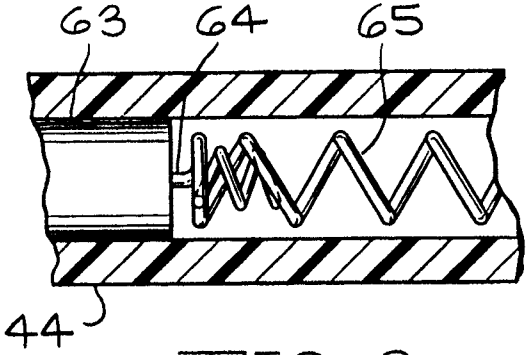
FIG. 3 is an enlarged, fragmentary, cross sectional view of a portion of the resistor tube, showing the connection between the electrical resistor and the coil spring.

The longitudinally extending resistor tube 44 is positioned within the fluid tube 57. An electrical resistor 63 is positioned within the resistor tube 44. In the present embodiment (see FIG. 3), a contact wire 64 extends from the rear end of the electrical resistor 63. A compression spring 65 is positioned within the resistor tube 44 and is connected by soldering or the like to the contact wire 64. The compression spring 65 has a rear end 66 in electrical communication with the high voltage power supply 18. A cap 67 is threadably mounted to the front end of the resistor tube 44 and defines an axially extending cap passageway 68. A charging electrode 69 extends outwardly from the electrical resistor 63, through the cap passageway 68, across the central passageway 58 of the fluid tube 57 and into the fluid discharge tip 56. The charging electrode 69 is effective to charge the fluid coating material as it passes from the fluid tube central passageway 58 and through the fluid discharge tip 56. Accordingly, the fluid coating material, such as paint, is charged, normally negatively charged, to a coating material voltage of between 40–100 KV. The electrical resistor 63 is normally between 50 to 200 megohms.

It is known in the art that a high voltage electrical static charge at the bell cup has the ability to create an arc to any approaching grounded object. An arc of sufficient energy can ignite the fluid coating material being fed to the bell cup or being atomized and create a hazardous condition. The rotary atomizer coater 10 including the electrical resistor 63 positioned directly within the housing 11 lowers the possibility of a high energy arc between the high voltage at the bell cup 45 and a nearby grounded object. The resistor 63 is positioned within the sealed insulated resistor tube 44. The front end of the resistor tube 44 is in close proximity with the interior 46 of the bell cup 44, with the fluid discharge tip 56 extending through the inlet opening 47 of the bell cup 45 directly into the interior 46. The portion of the resistor tube 44 which makes contact with the high voltage of the power supply 18 is electrically insulated from the coating fluid in the fluid tube 57. Consequently, high voltage is provided to the coating fluid and to the fluid discharge tip 56 which extends directly through the inlet opening 47 into the internal rear portion of the bell cup 45. As grounded objects approach the charged bell cup 45, the current through the air gap between the bell cup 45 and the grounded object will increase and cause a voltage drop across the electrical resistor 63 within the resistor tube 44 thereby reducing the voltage at the bell cup 45 and diminishing the potential for a high energy spark to occur.

Another feature of the preferred embodiment, is that positioning of the resistor tube 44 within the fluid tube 57 results in a heat transfer between the heat generated by the resistor 63 and the coating fluid which is passing through the central passageway 58 of the fluid tube 57.

Figure 4:
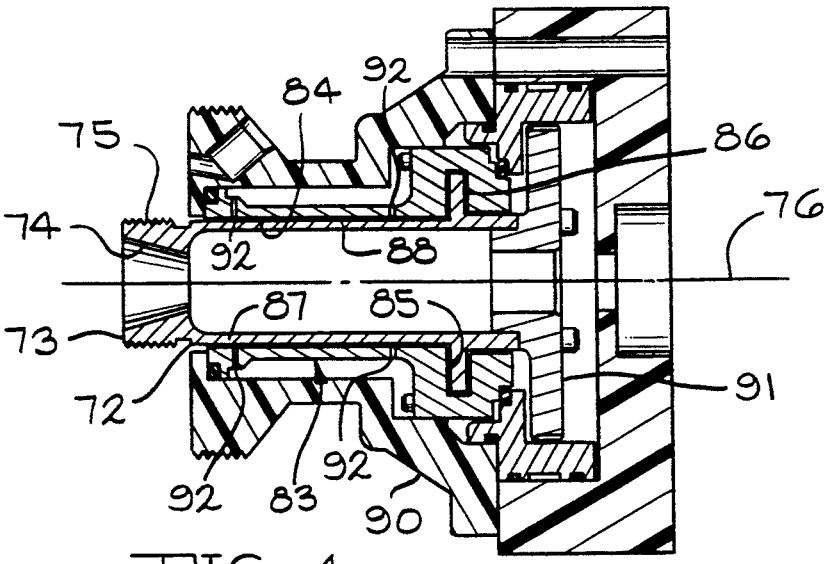
FIG. 4 is an enlarged cross sectional view of the turbine, the air bearing assembly and the rotatable shaft.

The bell cup 45 rotates around the longitudinally extending axis of a turbine driven shaft 72 (see FIGS. 2 and 4). The shaft 72 is normally metallic and includes a front end 73. The front end 73 of the shaft 72 includes an inner outwardly tapered conical surface 74 and an opposed outer threaded surface 75 which is generally parallel to the axis of rotation indicated by the reference number 76 in FIG. 4. The bell cup 45 is mounted on and rotates with the shaft 72 at high speeds, often in the range of between 10,000 and 40,000 rpm. It is important that the bell cup 45 be mounted in a precision manner to the front end 73 of the shaft 72. In the present embodiment, the bell cup 45 has a conical wall 78 which defines an outer tapered surface 79. The surface 79 mates with the inner tapered surface 74 of the shaft 72. The mating of the conical surfaces 74 and 79 provide the desired precision mounting of the bell cup 45 relative to the shaft 72. The bell cup 45 also includes a rearwardly directed generally cylindrical wall 80 which is attached to the conical wall 78. The cylindrical wall 80 has an inner surface 81 which defines threads which mate with the outer threaded surface 75 of the shaft 72. This results in the ability to have a shorter shaft and bell cup extension, which tends to reduce bell and shaft balancing requirements for the required high speed operation.

Referring to FIG. 4, an aluminum air bearing assembly 83 is mounted in the housing 11. The air bearing assembly 83 defines a central longitudinally extending opening 84 which is concentric with the axis of rotation 76. The shaft 72 is mounted for rotation in the opening 84 of the air bearing assembly 83. The assembly 83 defines a circular groove 85 which receives a circular flange 86 which extends outwardly from the shaft 72. The groove 85 and the flange 86 retard movement of the shaft 72 longitudinally along the axis 76. The air bearing assembly 83 includes an aluminum inner surface 87 which is anodized. Preferably, a layer of a tetrafluoroethene homopolymer, such as a TEFLON material 88, is impregnated into the anodized surface 87. Referring to FIG. 1, a turbine assembly 90 includes a driven turbine wheel 91. The turbine wheel 91 is connected to and drives the shaft 72, which in turn rotates the bell cup 45. A plurality of drilled openings 92 extend through the air bearing assembly 83. The openings 92 direct bearing air against the shaft 72. The rotating shaft 72 rides on the layer of air supplied through the openings 92. The TEFLON material 88 impregnated within the inner surface 87 reduces friction that can occur if the rotating shaft 72 makes contact with the inner bearing surface 87.

The turbine assembly 90 defines an exhaust air passageway, generally indicated by the reference number 94 in FIG. 1. A plurality of exhaust air openings 95 are circumferentially spaced at the front end 16 of the housing 11. Exhaust air is directed forwardly of the housing 11 to form a protective, generally cylindrical air layer. Referring to FIG. 1, a shaping air supply including a shaping air conduit 97 directs shaping air through a plurality of shaping air passageways 98 which are defined by the housing 11 and are concentric with the bell cup 45. The use of shaping air is known in the art and urges the charged fluid particles toward the target. This high velocity shaping air creates a negative pressure zone adjacent to itself and causes ambient air to be drawn towards and along side of the shaping air. Often, atomized and charged coating particles in the vicinity are drawn backwardly and into this active air movement where they tend to become deposited on the surface of an atomizer housing. In the present rotary atomizer coater 10, exhaust air is directed through the exhaust air openings 95 and forms a protective, generally cylindrical air layer radially outwardly of the shaping air stream to retard the movement of charged coating spray particles from moving toward the shaping air stream and the housing 11.

Referring to FIG. 5, in the present embodiment, the fluid manifold 33 defines a threaded opening 100. The resistor tube 44 has an integral plug member 101 having an outer threaded surface 102. The threaded surface 102 of the resistor tube 44 is threadably engaged in the threaded opening 100 of the fluid manifold 33. The fluid tube 44 including the integral plug member 101 is preferably constructed of a non-conductive material, such as a plastic material. One material which can be used is an acetal plastic material. The plug member 101 consists of a plurality of concentric rings 103 having concentric grooves 104 defined therebetween. Referring to FIGS. 1 and 2, the high voltage power supply 18 includes a mating plug 105 at its front end. The mating plug 105 has concentric rings 106 and concentric grooves 107. When the plug member 101 is joined with the mating plug 105, as shown in FIG. 1, the rings and grooves mate with one another to ensure a proper electrical contact with the rear end 66 of the compression spring 65 and an output contact 109 of the power supply 18.

Referring to FIG. 7, the turbine assembly 90 includes a turbine cover 111 which defines a plurality of openings in its rear end 112. Some openings for mounting bolts and the like have been omitted for clarity, in FIG. 7. An opening 113 receives the shaping air conduit 97. A brake air opening 114; a turbine air opening 115 and a central opening 116 are also provided. The central opening 116 receives an enlarged portion 117 of the fluid tube 57 (see FIG. 5).

The low voltage line 19 consists of a plurality of flexible connecting wires which are connected by the electrical connector 21 to the rear of the high voltage power supply 18. The potted high voltage supply contains an oscillator, a transformer and a voltage doubler network which provides a high voltage of 20–100 KV DC at its output contact 109. This high voltage is connected to the resistor tube 44 using the concentric interlocking insulator rings of the plug members 101 and 105. The concentric insulator rings provide a suitable insulated distance between the high voltage and any nearby electrical grounds. Current flows through the electrical resistor 63 located within the insulated resistor tube 44 to the protruding charging electrode 69 at the forward end. The charging electrode 69 makes electrical contact with the fluid discharge tip 56 and the coating fluid within the tip 56. The fluid tip 56 protrudes into the small inlet opening 47 defined by the rotating bell cup 45. High voltage of the coating fluid and the fluid discharge tip 56 is communicated to the bell cup 45 such that a high voltage is present on the bell cup 45 and on the atomized coating particles which fly off the annular discharge edge 48 of the bell cup 45.

The overall fluid system includes the fluid manifold 33 which has connection ports provided for the three pneumatically operated valves 32. The fluid connections consists of fluid in, solvent in and dump out. The valves may be designated trigger or coating, solvent and dump.

A typical operating mode for the fluid system is as follows:

Fluid passage and bell cup cleaning are accomplished by closing the trigger valve and opening the solvent valve. Electrostatic voltage is disconnected during solvent flow. For coating, the trigger valve is opened and the solvent and dump valves are closed. Fluid flows from the fluid manifold into the fluid tube annulus around the resistor tube where it exits the electrostatically charged fluid discharge tip and attaches to the inner rotating surface of the bell cup. The fluid is centrifuged to the annular discharge edge where it is atomized. Heat which is generated by electrical current within the resistor is removed by fluid flowing across the surface of the resistor tube. For color changing of system cleaning, the fluid trigger valve remains closed while the dump valve is opened. The coating fluid passes into the fluid manifold through the trigger valve and through the open dump valve where it exits the fluid a manifold via the dump out connection. If cleaning is desired, a solvent is fed through the fluid line and completely through the system. For color changing to a second color fluid, the second color fluid follows the initial color fluid such that it flows through the fluid passages behind the initial fluid and is available at the trigger valve.

Many changes and modifications may be made to the above described preferred embodiments without departing for the scope of the present invention or from the following claims.

I claim:

1. A rotary atomizer coater comprising, in combination, a housing having a front end and a rear end, a shaft rotatably mounted in said housing along a longitudinal axis, a bell cup mounted on said shaft and having an interior open directly to atmosphere and terminating at a circular discharge edge, said bell cup being rotatably mounted adjacent said front end of said housing, said bell cup defining an inner side surface and an inlet opening, said bell cup including an inner surface on such interior and a radially extending shoulder mounted on said inner conical surface, a coating supply means mounted within said housing, said coating supply means including a fluid discharge tip extending through said inlet opening for supplying charged coating fluid, from said coating supply means directly to said inner side surface of said bell cup interior, said fluid discharge tip defining at least one discharge opening for discharging the charged fluid coating to said inner side surface in a direction generally perpendicular to said longitudinal axis, said inner side surface being adjacent to said discharge opening of said-fluid discharge tip.

2. A rotary atomizer coater, according to claim 1, including a plurality of axial openings extending through said shoulder, said axial openings being circumferentially spaced around said shoulder, whereby said shoulder and said openings distribute fluid coating evenly to said discharge edge.

3. A rotary atomizer coater, according to claim 2, wherein such openings comprise axial grooves or holes.

4. A rotary atomizer coater comprising, in combination, a housing having a front end and a rear end, a shaft rotatably mounted in said housing along a longitudinal axis, a bell cup mounted on said shaft and having an interior open directly to atmosphere and terminating at a circular discharge edge, said bell cup being rotatably mounted adjacent said front end of said housing, said bell cup defining an inner side surface and an inlet opening, a coating supply means mounted within said housing, said coating supply means including a fluid discharge tip extending through said inlet opening for supplying charged coating fluid, from said coating supply means directly to said inner side surface of said bell cup interior, said fluid discharge tip defining at least one discharge opening for discharging the charged fluid coating to said inner side surface in a direction generally perpendicular to said longitudinal axis, said inner side surface being adjacent to said discharge opening of said fluid discharge tip, an aluminum air bearing assembly mounted in said housing, said bearing assembly defining a longitudinally extending opening having a circular cross section, said rotatable shaft mounted in such bearing opening and a plurality of openings extending through said bearing for directing bearing air to said shaft.

5. A rotary atomizer coater, according to claim 4, wherein said bearing assembly has an inner surface defining such longitudinally extending opening, said inner surface being anodized, and a tetrafluoroethene homopolymer impregnated in said inner surface adjacent said shaft.

6. A rotary atomizer coater comprising, in combination, a housing having a front end and a rear end, a bell cup having an interior open to atmosphere and terminating at a circular discharge edge rotatably mounted adjacent said front end of said housing, said bell cup defining an inner side surface and an inlet opening, a coating supply means mounted within said housing, said coating supply means including a fluid discharge tip extending through said inlet opening for supplying charged coating fluid directly to said inner surface of said bell cup interior and a longitudinally extending fluid tube defining a central passageway for supplying fluid coating, said discharge fluid tip being mounted on said fluid tube, an electrical resistor means positioned within said fluid tube, a charging electrode mounted within said housing adjacent said fluid discharge tip, whereby, when a ground object approaches said bell cup, the current between the bell cup and the grounded object will increase and a voltage drop across the resister means results, thereby reducing the voltage at the bell cup and diminishing the potential for a high energy spark, said electrical resistor means including a resistor tube positioned within said fluid tube, whereby coating fluid engages said resistor tube, an electric resistor positioned within said resistor tube, said resistor tube mounting said charging electrode, spring means adjacent said resistor, and a power supply mounted within said housing, said spring means, said resistor and said charging electrode being in electrical communication with said power supply.

7. A rotary atomizer coater, in combination, a housing having a front end and a rear end, a bell cup having an interior open to atmosphere and terminating at a circular discharge edge rotatably mounted adjacent said front end of said housing, said bell cup defining an inner side surface and an inlet opening, a coating supply means mounted within said housing, said coating supply means including a fluid discharge tip extending through said inlet opening for supplying charged coating fluid directly to said inner surface of said bell cup interior, a turbine driven shaft rotatably mounted in said housing, said shaft including a front end, said shaft front end including an inner outwardly tapered surface and an opposed outer threaded surface, said bell cup having a conical wall defining an outer tapered surface mating with said inner tapered surface of said shaft and a rearwardly directed cylindrical wall attached to said conical wall, said cylindrical wall having an inner surface defining threads which mate with said outer threaded surface of said shaft.

8. A rotary atomizer coating comprising, in combination, a housing having a front end and a rear end, a bell cup having an interior open to atmosphere and terminating at a circular discharge edge rotatably mounted adjacent said front end of said housing, said bell cup defining an inner side surface and an inlet opening, a coating supply means mounted within said housing, said coating supply means including a fluid discharge tip extending through said inlet opening for supplying charged coating fluid directly to said inner side surface of said bell cup interior, and an aluminum air bearing assembly mounted in said housing, said bearing assembly defining a longitudinally extending opening having a circular cross section, a rotatable shaft mounted in such bearing opening, said shaft mounting said bell cup, and a plurality of openings extending through said bearing for directing bearing air to shaft.

9. A rotary atomizer coater, according to claim 8, wherein said bearing has an inner surface defining such longitudinally extending opening, said inner surface being anodized, and a tetrafluoroethene homopolymer impregnated in said inner surface adjacent said shaft.

10. A rotary atomizer coater comprising, in combination, a housing having a front end and a rear end, a bell cup having an interior open to atmosphere and terminating at a circular discharge edge rotatably mounted adjacent said front end of said housing, said bell cup defining an inner side surface and an inlet opening, a coating supply means mounted within said housing, said coating supply means including a fluid discharge tip extending through said inlet opening for supplying charged coating fluid directly to said inner side surface of said bell cup interior, said housing including a plastic shroud and a rear plastic cover, a potted power supply mounted within said housing adjacent said rear end, said power supply including heat producing components, a metallic member mounted within said potted power supply adjacent said rear plastic cover, said metallic member extending rearwardly from said plastic cover and including an electrical connector in communication with said power supply, a plurality of fins extending outwardly from said metallic member, said heat producing components within said potted power supply being positioned adjacent said metallic member and protruding through said rear plastic cover, whereby said metallic member including said fins transfer heat from said heat producing components to atmosphere.

11. A rotary atomizer coater comprising, in combination, a housing having a front end and rear end, a shaft rotatably mounted in said housing along a longitudinal axis, a bell cup mounted on said shaft and having an interior open directly to atmosphere and terminating at a circular discharge edge, said bell cup being rotatably mounted adjacent said front end of said housing, said bell cup defining an inner side surface and an inlet opening, a coating supply means mounted within said housing, said coating supply means including a fluid discharge tip extending through said inlet opening for supplying charged coating fluid, from said coating supply means directly to said inner side surface of said bell cup interior, said coating supply means including a longitudinally extending fluid tube defining a central passageway for supplying such fluid coating, said discharge fluid tip being mounted on said fluid tube, said fluid discharge tip defining at least one discharge opening for discharging the charged fluid coating to said inner side surface in a direction generally perpendicular to said longitudinal axis, said inner side surface being adjacent to said discharge opening of said fluid discharge tip, an electrical resistor means positioned within said fluid tube, a charging electrode mounted within said housing adjacent said fluid discharge tip, whereby, when a ground object approaches said bell cup, the current between the bell cup and the grounded object will increase and a voltage drop across the resistor means results, thereby reducing the voltage at the bell cup and diminishing the potential for a high energy spark, said electrical resistor means includes a resistor tube positioned within said fluid tube, whereby coating fluid engages said resistor tube, an electric resistor positioned within said resistor tube, said resistor tube mounting said charging electrode, spring means adjacent said resistor, and a power supply mounted within said housing, said spring means, said resistor and said charging electrode being in electrical communication with said power supply.

12. A rotary atomizer coater comprising, in combination, a housing having a front end and a rear end, a shaft rotatably mounted in said housing along a longitudinal axis, a bell cup mounted on said shaft and having an interior open directly to atmosphere and terminating at a circular discharge edge, said bell cup being rotatably mounted adjacent said front end of said housing, said bell cup defining an inner side surface and an inlet opening, said shaft comprising a turbine driven shaft rotatably mounted in said housing, said shaft including a front end, said shaft front end including an inner outwardly tapered surface and an opposed outer threaded surface, said bell cup having a conical wall defining an outer tapered surface mating with said inner tapered surface of said shaft and a rearwardly directed cylindrical wall attached to said conical wall, said cylindrical wall having an inner surface defining threads which mate with outer threaded surface of said shaft, a coating supply means mounted within said housing, said coating supply means including a fluid discharge tip extending through said inlet opening for supplying charged coating fluid from said coating supply means directly to said inner side surface of said bell cup interior, said fluid discharge tip defining at least one discharge opening for discharging the charged fluid coating to said inner side surface in a direction generally perpendicular to said longitudinal axis, said inner side surface being adjacent to said discharge opening of said fluid discharge tip.

13. A rotary atomizer coater comprising, in combination, a housing having a front end and a rear end, a shaft rotatably mounted in said housing along a longitudinal axis, a bell cup mounted on said shaft and having an interior open directly to atmosphere and terminating at a circular discharge edge, said bell cup being rotatably mounted adjacent said front end of said housing, said bell cup defining an inner side surface and an inlet opening, a coating supply means mounted within said housing, said coating supply means including a fluid discharge tip extending through said inlet opening for supplying charged coating fluid, from said coating supply means directly to said inner side surface of said bell cup interior, said fluid discharge tip defining at least one discharge opening for discharging the charged fluid coating to said inner side surface in a direction generally perpendicular to said longitudinal axis, said inner side surface being adjacent to said discharge opening of said fluid discharge tip, said housing including a plastic shroud and a rear plastic cover, a potted power supply mounted within said housing adjacent said rear end, said power supply including heat producing components, a metallic member mounted within said potted power supply adjacent said rear plastic cover, said metallic member extending rearwardly from said plastic cover and including an electrical connector in communication with said power supply, a plurality of fins extending outwardly from said metallic member, said heat producing components within said potted power supply being positioned adjacent said metallic member and protruding through said rear plastic cover, whereby said metallic member including said fins transfer heat from said heat producing components to atmosphere.

* * * * *